US012233445B2

(12) United States Patent
Ageba

(10) Patent No.: US 12,233,445 B2
(45) Date of Patent: Feb. 25, 2025

(54) PRESS FORMING METHOD

(71) Applicant: JFE STEEL CORPORATION, Tokyo (JP)

(72) Inventor: Ryo Ageba, Tokyo (JP)

(73) Assignee: JFE STEEL CORPORATION, Tokyo (JP)

( * ) Notice: Subject to any disclaimer, the term of this patent is extended or adjusted under 35 U.S.C. 154(b) by 173 days.

(21) Appl. No.: 17/926,015

(22) PCT Filed: Apr. 8, 2021

(86) PCT No.: PCT/JP2021/014847
§ 371 (c)(1),
(2) Date: Nov. 17, 2022

(87) PCT Pub. No.: WO2021/241024
PCT Pub. Date: Dec. 2, 2021

(65) Prior Publication Data

US 2023/0173566 A1 Jun. 8, 2023

(30) Foreign Application Priority Data

May 23, 2020 (JP) ..... 2020-090156

(51) Int. Cl.
*B21D 19/08* (2006.01)
*B21D 53/88* (2006.01)

(52) U.S. Cl.
CPC ..... *B21D 19/08* (2013.01); *B21D 53/88* (2013.01)

(58) Field of Classification Search
CPC ..... B21D 22/22; B21D 22/26; B21D 53/88
See application file for complete search history.

(56) References Cited

U.S. PATENT DOCUMENTS 4,756,466 A * 7/1988 Peck ..... B23K 31/02 228/173.6
2015/0273563 A1* 10/2015 Miyagi ..... B21D 22/22 29/897.2

(Continued)

FOREIGN PATENT DOCUMENTS

EP 3 476 500 A1 5/2019
EP 3297777 B1 * 11/2021 ..... B21D 19/08

(Continued)

OTHER PUBLICATIONS

EP-3297777-B1 translation (Year: 2021).*

(Continued)

*Primary Examiner* — Michael W Hotchkiss
(74) *Attorney, Agent, or Firm* — Oliff PLC

(57) ABSTRACT

A press forming method forms a press forming part including: a top portion having a convex and concave outer edge part where a convex outer edge part protruding outward in an in-plane direction and a concave outer edge part recessed inward in the in-plane direction are continuous to each other via a connecting outer edge part; and a flange portion continuously formed on the convex and concave outer edge part, and includes: forming a preformed part including a flange portion formed in the convex outer edge part and including a torsional shape portion having a torsional shape toward the concave outer edge part so as to be formed in the connecting outer edge part continuous from the flange portion; and forming the preformed part into a target shape by forming the torsional shape portion into the flange portion and forming the flange portion in the concave outer edge part.

3 Claims, 4 Drawing Sheets

(56) References Cited

U.S. PATENT DOCUMENTS

| | | | | |
|---|---|---|---|---|
| 2016/0199897 | A1 | 7/2016 | Otsuka et al. | |
| 2019/0030583 | A1 * | 1/2019 | Nishimura | B21D 5/002 |
| 2021/0268566 | A1 | 9/2021 | Tabata et al. | |

FOREIGN PATENT DOCUMENTS

| | | | | |
|---|---|---|---|---|
| JP | S60-210326 | A | 10/1985 | |
| JP | S61-222640 | A | 10/1986 | |
| JP | 2007-253173 | A | 10/2007 | |
| JP | 6032374 | B2 | 11/2016 | |
| JP | 2019-171440 | A | 10/2019 | |
| WO | 2014/017436 | A1 | 1/2014 | |
| WO | WO-2016017228 | A1 * | 2/2016 | B21D 22/26 |
| WO | WO-2016088519 | A1 * | 6/2016 | B21D 22/20 |
| WO | 2020/026356 | A1 | 2/2020 | |

OTHER PUBLICATIONS

WO2016017228A1 Translation (Year: 2016).*
WO2016088519A1 Translation (Year: 2016).*
Jul. 6, 2021 International Search Report issued in International Patent Application No. PCT/JP2021/014847.
Sep. 11, 2023 Extended Search Report issued in European Patent Application No. 21813134.0.
Dec. 11, 2024 Office Action issued in Korean Patent Application No. 10-2022-7040619.

* cited by examiner

PRESS FORMING METHOD

FIELD

The present invention relates to a press forming method applicable to press forming of a part such as an automotive part from a metal sheet, and particularly relates to a press forming method applicable to formation of a press forming part including: a top portion having a convex and concave part in an in-plane direction; and a flange portion continuously formed from the top portion.

BACKGROUND

In recent years, in order to achieve weight reduction of automotive body due to environmental problems, high-strength steel sheets have been frequently used for automotive parts. However, a high-strength steel sheet is poor in elongation as compared with a steel sheet having low strength and thus tends to cause fracture during material processing. In addition, when a high-strength steel sheet is used, thinning of the sheet is also performed at the same time for further weight reduction, leading to a problem of high likelihood of occurrence of buckling of the steel sheet and occurrence of wrinkles during press forming. Therefore, development of a press forming method for suppressing fracture and wrinkles is strongly required.

For example, Patent Literature 1 discloses a press forming method that uses a wrinkle suppression pad (blank holder) driven separately from a punch and dies for press (dies) and makes it possible to manufacture an automotive part which is likely to cause wrinkles and stretch flange fractures inside a product with no forming defectiveness. The method disclosed in Patent Literature 1 is considered to be able to manufacture an automotive part that is likely to cause wrinkles and fractures inside a product without forming defectiveness.

CITATION LIST

Patent Literature

Patent Literature 1: JP 6032374 B2

SUMMARY

Technical Problem

However, the press forming method disclosed in Patent Literature 1 is a method that needs to hold down the inside of the product away from the flange using a wrinkle suppression pad (blank holder). Therefore, the method has a problem that the technique cannot be applied to a shape having occurrence of wrinkles or fractures in the flange portion itself.

The present invention has been made in view of the above problem, and aims to provide a press forming method applicable to a press forming part having an occurrence of wrinkles and fractures in a flange itself and capable of simultaneously suppressing the wrinkle and fracture occurring in the flange.

Solution to Problem

A press forming method according to the present invention for forming a press forming part, the press forming part including: a top portion having a convex and concave outer edge part in which a convex outer edge part protruding outward in an in-plane direction and a concave outer edge part recessed inward in the in-plane direction are continuous to each other via a connecting outer edge part; and a flange portion continuously formed on the convex and concave outer edge part of the top portion, includes: a first forming step of forming a preformed part, the preformed part including a flange portion formed in the convex outer edge part and including a torsional shape portion having a torsional shape toward the concave outer edge part so as to be formed in the connecting outer edge part continuous from the flange portion; and a second forming step of forming the preformed part formed in the first forming step into a target shape by forming the torsional shape portion into the flange portion and forming the flange portion in the concave outer edge part.

The first forming step and the second forming step may be performed by using different dies.

The first forming step and the second forming step may be performed with one die.

Advantageous Effects of Invention

According to the press forming method according to the present invention, the occurrence of wrinkles due to shrink flange forming is suppressed in the first forming step, and the occurrence of fractures due to stretch flange forming is suppressed in the second forming step, leading to suppression of the occurrence of wrinkles and fractures throughout all steps.

DESCRIPTION OF EMBODIMENTS

Figure 6:
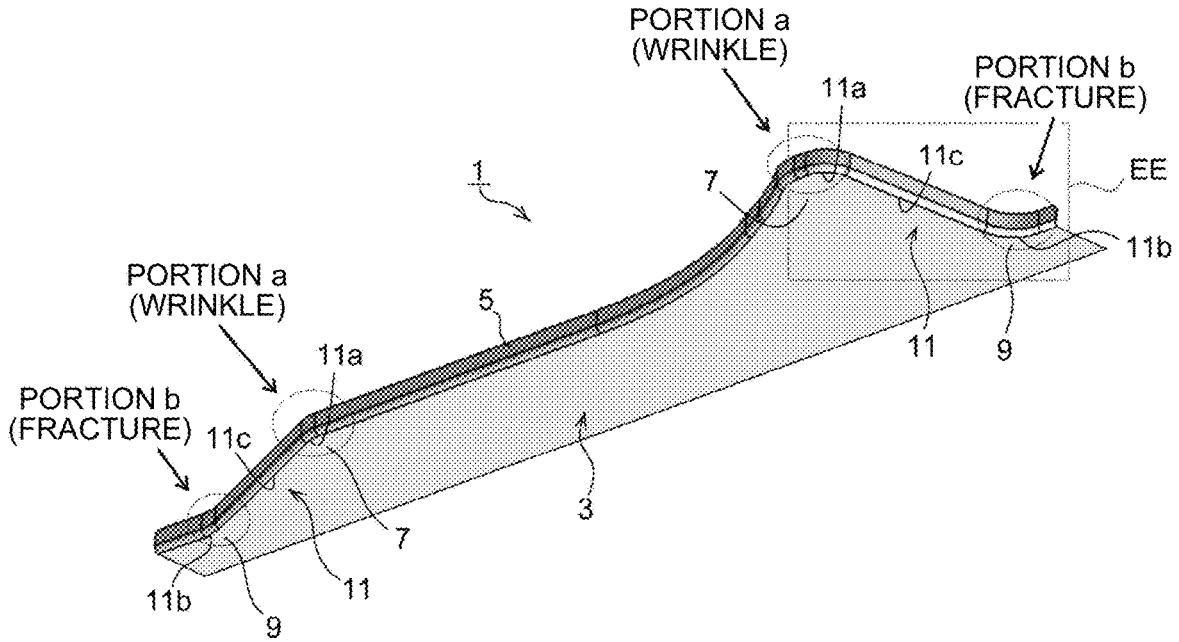
FIG. 6 is a view illustrating a target shape and a problem occurring in a forming process of the target shape according to the embodiment.

Prior to the description of the press forming method according to the present embodiment, an example of a press forming part to be formed in the present invention will be described with reference to FIGS. 6 and 7. A press forming part 1 illustrated in FIG. 6 is drawn as a perspective view of a slide door rail which is an automotive part, and includes a top portion 3 and a flange portion 5. The top portion 3 has a convex part 7 protruding outward in the in-plane direction and a concave part 9 adjacent to the convex part 7 and recessed inward in the in-plane direction. The outer periphery of the top portion 3 is a convex and concave outer edge part 11 formed by a convex outer edge part 11*a* which is an outer peripheral side of the convex part 7, a concave outer edge part 11*b* which is an outer peripheral side of the concave part 9, and a connecting outer edge part 11*c* connecting the convex outer edge part 11*a* and the concave outer edge part 11*b* to each other. The flange portion 5 is formed on the convex and concave outer edge part 11. In the case of an actual slide door rail, a bent portion is formed on an outer edge part of the top portion 3 facing the convex and concave outer edge part 11 where the flange portion 5 is formed. However, FIG. 6 omits illustration of the bent portion.

When such a press forming part 1 is formed by a conventional press forming method, the flange portion 5 formed in the convex outer edge part 11*a* subjected to shrink flange forming (portion a circled by a broken line in the drawing), and wrinkles are likely to occur due to the excess metal. On the other hand, the flange portion 5 formed in the concave outer edge part 11*b* is subjected to stretch flange forming (portion b circled by a broken line in the drawing), and is likely to have fractures due to a material shortage.

A mechanism of occurrence of the wrinkles and the fractures will be described with reference to FIG. 7. FIG. 7 is a diagram illustrating a material flow in the forming process in portion EE surrounded by the broken line in FIG. 6, illustrating a top view (FIG. 7(*a*)) and a side view of (FIG. 7(*b*)) of FIG. 6. In FIG. 7, a broken line is a tip of the blank before forming, and a solid line is an edge of the flange portion 5 formed into a target shape. Further, points D and B in the drawing are points corresponding to the R-finish (the boundary between a curve and a straight line) of the convex outer edge part 11*a* in the blank before forming, and corresponding intersections of lines perpendicular to the edge of the target shape from points D and B in the top view and the edge of the target shape are points D' and B'. Similarly, points A and E in the drawing are points corresponding to the R-finish of the concave outer edge part 11*b* in the blank before forming, and corresponding points of intersection between a line perpendicular to the edge of the target shape from points E and A in the top view and the edge of the target shape are points A' and E'. As illustrated in the top view of FIG. 7(*a*), since the material flows substantially perpendicularly to the ridge line (bending line), the material flows in a direction in which the material gathers in portion a, and flows in a direction in which the material leaves in portion b. Accordingly, wrinkles are likely to occur in portion a, while fractures are likely to occur in portion b.

In order to solve such a problem, the inventors have devised a press forming method in which a preformed part, which facilitates inflow of a material from a portion where shrink flange forming occurs to a portion where stretch flange forming occurs, is interposed in the middle of forming, thereby enabling avoidance of concentration of compressive strain and tensile strain in each of the portions. Specifically, the press forming method has the following configuration.

Figure 1:
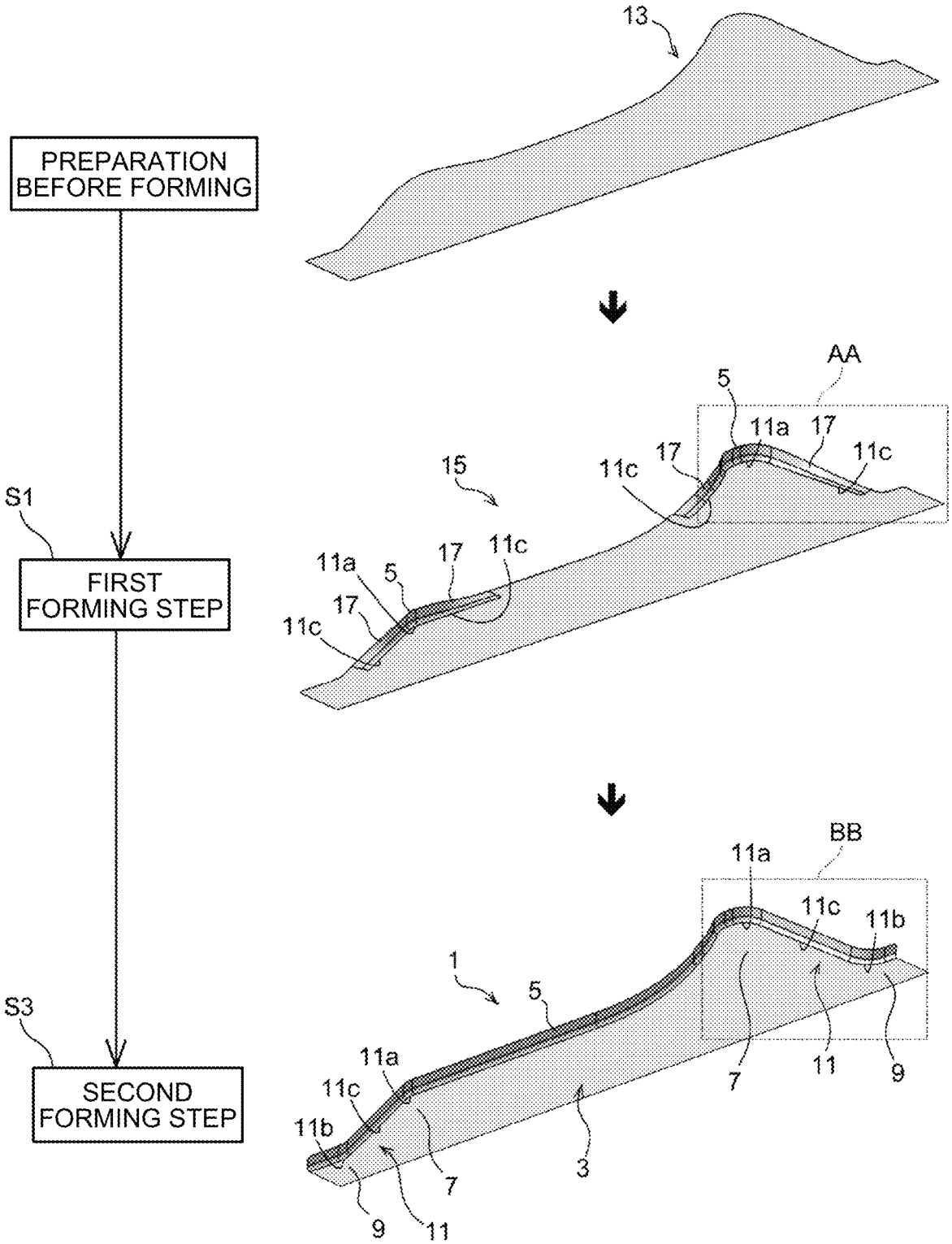
FIG. 1 is a view illustrating a press forming method according to an embodiment of the present invention.

As illustrated in FIG. 1, the press forming method according to the present embodiment includes: a first forming step S1 of forming a blank made of a metal sheet 13 into a preformed part 15; and a second forming step S3 of forming the preformed part 15 formed in the first forming step S1 into a target shape. Each of the steps will be described below. In FIG. 1, the portions same as those in FIG. 6 illustrating the target shape are denoted by the same reference numerals.

<First Forming Step>

The first forming step S1 is a step of forming the preformed part 15 from the blank. The preformed part 15 includes: a flange portion 5 formed in the convex outer edge part 11*a*; and a torsional shape portion 17 formed in the connecting outer edge part 11*c* having the target shape continuously formed from the flange portion 5.

Figure 2:
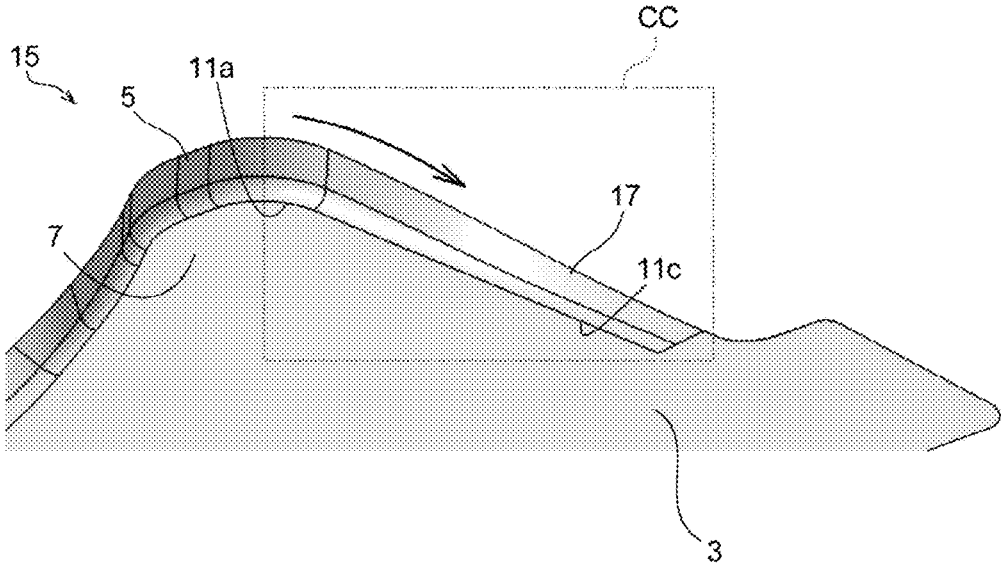
FIG. 2 is an enlarged view of portion AA of a preformed part in the first forming step in FIG. 1.

In the preformed part forming process in the first forming step S1, the flange portion 5 is formed in the convex outer edge part 11*a* of the top portion 3, although the torsional shape portion 17 is formed in the concave outer edge part 11*b* with no formation of the flange portion 5. As illustrated in FIG. 2, the torsional shape portion 17 is connected, on one end side, to the flange portion 5 formed on the convex outer edge part 11*a*, while being connected, the other end side, to the top portion 3 as a flat portion, forming the torsional shape portion 17 to have a torsional shape. At the time of forming the torsional shape portion 17, as indicated by an arrow in FIG. 2, a metal inflow occurs in a direction from the flange portion 5 side to be formed toward the flat portion, leading to alleviation of excess metal in the shrink flange forming and suppression of the occurrence of wrinkles.

Figure 3:
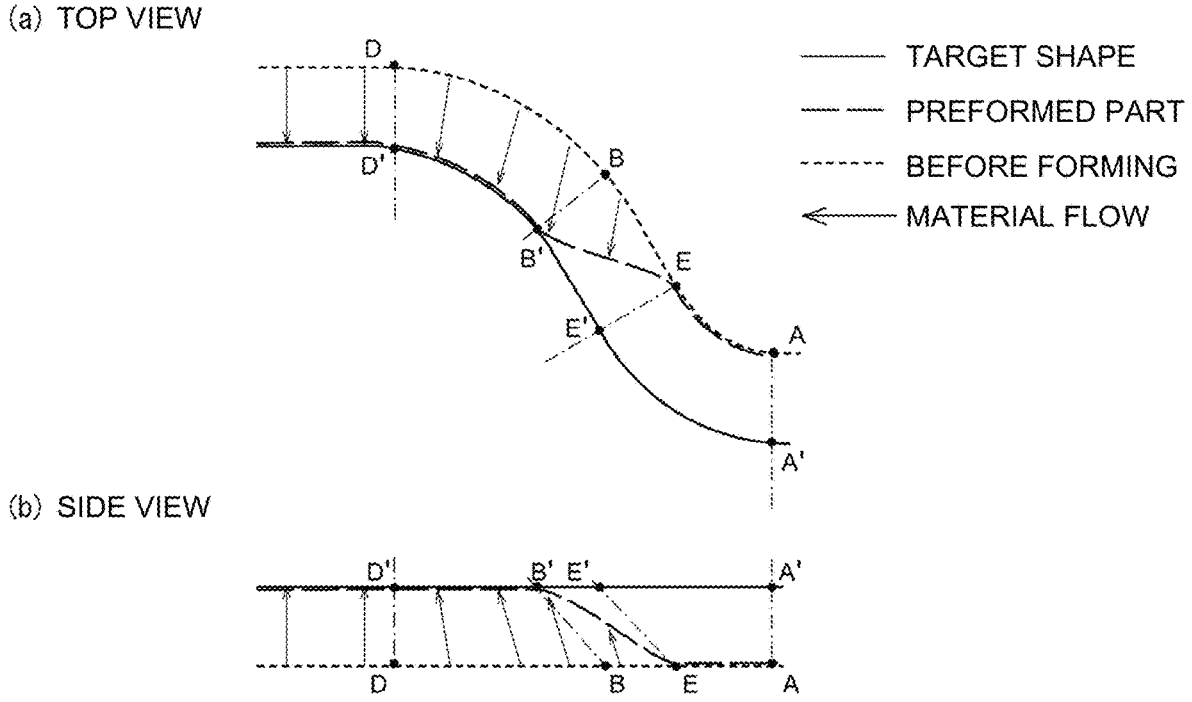
FIG. 3 is a view illustrating a mechanism of suppressing occurrence of wrinkles in the first forming step.

A mechanism of occurrence of the material flow will be described with reference to FIG. 3. FIG. 3 is a view illustrating the material flow in the forming process in portion CC surrounded by the broken line in FIG. 2, illustrating a top view and a side view of FIG. 2. In FIG. 3, a fine broken line is an edge of the blank before forming, a coarse broken line is an edge of the preformed part 15, and a solid line is an edge of the flange portion 5 in the target shape. Points A to E and points A' to E' in the drawing are the same as those illustrated in FIG. 7. That is, point A in the drawing is an R-finish of a curved portion in the blank, and is a tip position of the torsional shape portion 17. Point B is a point corresponding to one R-finish of the blank portion having occurrence of shrink flange forming in a conventional case, and point B' is an intersection of a line extending perpendicularly to the edge of the torsional shape portion 17 from point B in the top view and the edge of the torsional shape portion 17. Point D is an R-finish of the curved portion of the blank, and point D' is an intersection of a line perpendicular to the edge of the target shape from point D in the top view and the edge of the target shape.

Due to the shrink flange forming, the distance from point B' to point D' is shorter than the distance from point B to point D (B'D'<BD), and thus, wrinkles are likely to occur in the flange portion 5 formed in the convex outer edge part 11*a* due to the excess metal. On the other hand, since the distance from point A to point B' is longer than the distance from point A to point B (AB'>AB) in a three-dimensional view, the material is pulled toward point A and flows while deviating from "substantially perpendicular to the ridge line". Therefore, the material flow indicated by the arrow in FIG. 3 is generated, the material flow being closer to point A as compared with the conventional material flow indicated by the arrow in the wrinkle occurrence region in FIG. 7. This material flow alleviates the excess metal in shrink flange forming at the first forming step S1, leading to suppression of occurrence of wrinkles.

<Second Forming Step>

The second forming step S3 is a step of forming the torsional shape portion 17 of the preformed part 15 formed in the first forming step S1 into the flange portion 5, and forming the flange portion 5 in the concave outer edge part 11*b* so as to achieve formation of a target shape. In the forming process of the second forming step S3, as indicated by the arrow in FIG. 4, by returning the torsion of the torsional shape portion 17 that has absorbed the excess metal in FIG. 2, the excess metal causes the metal inflow into the stretch flange forming portion, alleviating the material shortage of the stretch flange forming portion, leading to suppression of occurrence of fracture.

Figure 4:
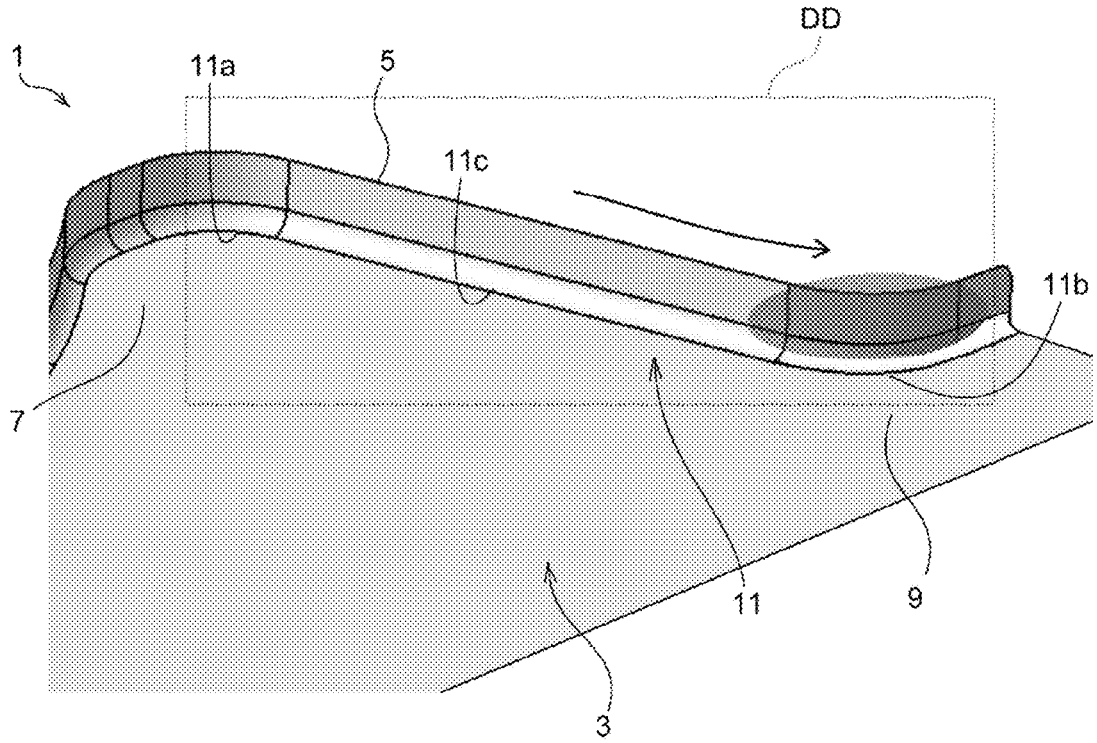
FIG. 4 is an enlarged view of portion BB of a target shape in the second forming step in FIG. 1.
Figure 5:
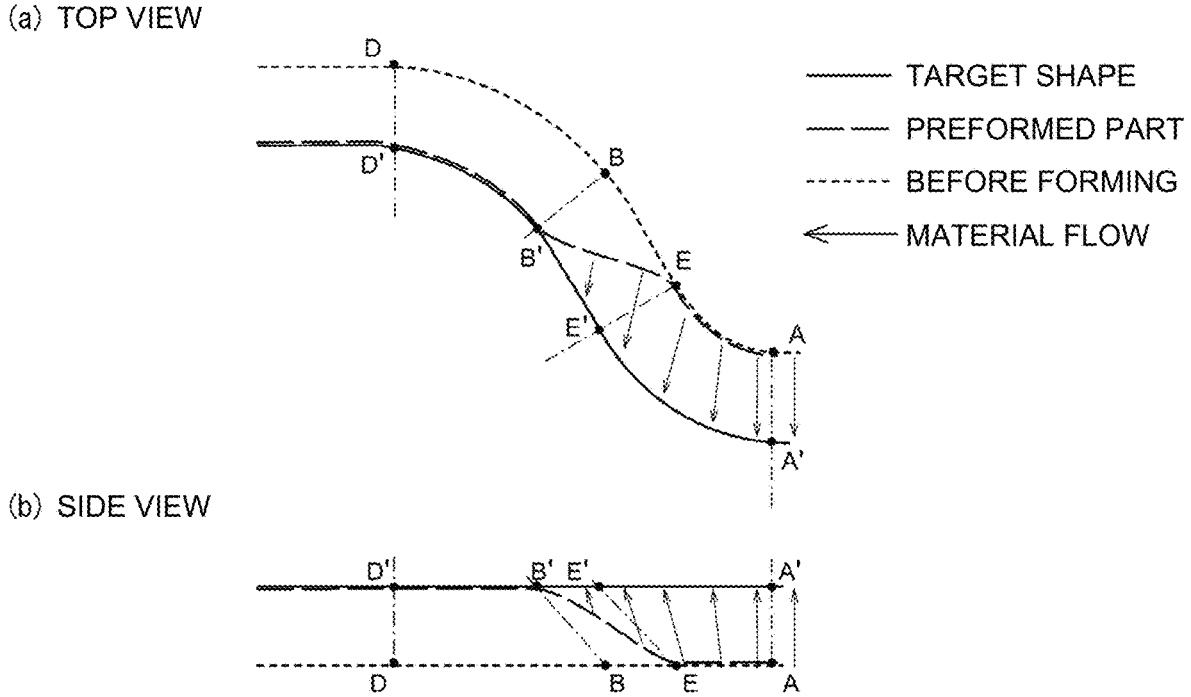
FIG. 5 is a view illustrating a mechanism of suppressing occurrence of fractures in the second forming step.

A mechanism of occurrence of the material flow will be described with reference to FIG. 5. FIG. 5 is a view illustrating the material flow in the forming process of the DD portion surrounded by the broken line in FIG. 4, illustrating a top view and a side view of FIG. 4. In FIG. 5, a fine broken line is an edge of the blank before forming, a coarse broken line is an edge of the torsional shape portion 17, and a solid line is an edge of the flange portion 5 in the target shape.

Figure 7:
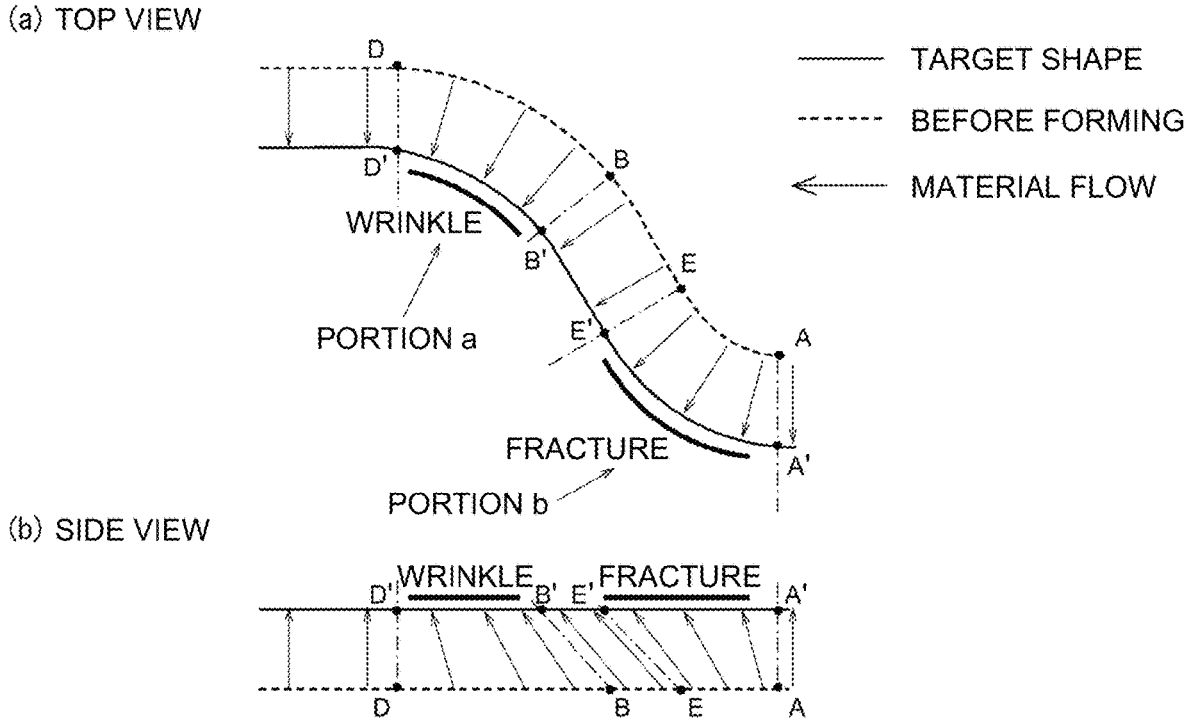
FIG. 7 is a diagram illustrating a mechanism of occurrence of wrinkles and fractures in the forming process of the target shape illustrated in FIG. 6.

In addition, points A to E and points A' to E' in the drawing are the same as those illustrated in FIGS. 7 and 3. That is, point A' in the drawing is an intersection of a line extending perpendicularly to the ridge line of the target shape in the top view from point A and the target shape. Point E is a point corresponding to one R-finish of the blank portion in which the conventional stretch flange forming occurs, and point E' is an intersection of a line perpendicular to the edge of the target shape from point E in the top view and the edge of the target shape. Due to the stretch flange forming, the distance from point A' to point E' is longer than the distance from point A to point E (A'E'>AE), and the material shortage is likely to cause an occurrence of fractures in the flange portion 5 formed in the concave outer edge part 11*b*. On the other hand, since the distance from point D' to point E' is shorter than the distance from point D' to point E (D'E'<D'E) in a three-dimensional view, the material is pushed toward the A' side and flows while deviating from "substantially perpendicular to the ridge line". Therefore, the material flow indicated by the arrow in FIG. 5 is generated, the material flow being closer to point A' as compared with the conventional material flow indicated by the arrow in the fracture occurrence region in FIG. 7. This material flow alleviates the material shortage in the stretch flange forming at the second forming step S3, leading to suppression of occurrence of fractures.

As described above, in the present embodiment, only the portion of occurrence of the shrink flange forming is formed first in the first forming step S1, whereby the torsional shape portion 17 that promotes the material flow toward the portion of occurrence of the stretch flange forming is formed in the forming process. By forming, in the second forming step S3, the portion that becomes the stretch flange forming, the target shape is formed while suppressing the material shortage due to the stretch flange forming by using the material flow from the torsional shape portion 17.

In this manner, by dispersing the strain of a dangerous portion where the stretch flange fracture occurs and a dangerous portion where the shrink flange wrinkles occur, it is possible to suppress the occurrence of wrinkles due to shrink flange forming in the first forming step S1, suppress occurrence of fractures due to the stretch flange forming in the second forming step S3, and suppress the occurrence of wrinkles and fractures throughout all the steps.

The first forming step and the second forming step of the present invention may be formed with different dies. Alternatively, the first forming step and the second forming step can be performed with one die.

EXAMPLE

In order to confirm the effect of the present invention, press forming was performed with a slide door rail member as illustrated in FIG. 6 as a target shape. The material was a steel sheet having a tensile strength of 1180 MPa class and a thickness of 1.4 mm. First, as Comparative Example, a target shape was formed in one step without forming the preformed part 15, and press forming was performed by a method of crash forming by using pad (pad forming), in which the top portion was held with a pad (pressure pad). Next, as an example of the present invention, press forming was performed including the first forming step S1 of forming the preformed part 15 in which only the shrink flange forming portion and the second forming step S3 of forming the preformed part 15 into a target shape, which are described in the embodiment, with each forming step performed by a method of crash forming by using pad, in which the top portion was held with a pad.

In the case of Comparative Example, wrinkles occurred in portion a and fractures occurred in portion b illustrated in FIG. 6, and the target shape was not successfully obtained. In contrast, in Example of the present invention, the press forming part of high quality was successfully obtained with no fracture or wrinkles in the flange portion 5. As described above, the present invention is proven to be effective for suppressing stretch flange fracture and shrink flange wrinkles in formation of a press forming part having convex and concave parts in the in-plane direction on the top portion 3.

INDUSTRIAL APPLICABILITY

According to the present invention, it is possible to provide a press forming method applicable to a press forming part having an occurrence of wrinkles and fractures in a flange itself and capable of simultaneously suppressing the wrinkles and fractures occurring in the flange.

REFERENCE SINGS LIST

1 PRESS FORMING PART
3 TOP PORTION
5 FLANGE PORTION
7 CONVEX PART
9 CONCAVE PART
11 CONVEX AND CONCAVE OUTER EDGE PART
11*a* CONVEX OUTER EDGE PART
11*b* CONCAVE OUTER EDGE PART
11*c* CONNECTING OUTER EDGE PART
13 METAL SHEET
15 PREFORMED PART
17 TORSIONAL SHAPE PORTION

The invention claimed is:

1. A press forming method for forming a blank into a press forming part, the press forming part including: a top portion having an outer edge part including: a convex outer edge part protruding outward in an in-plane direction; a concave outer edge part recessed inward in the in-plane direction; and a connecting edge part connecting the convex outer edge part and the concave outer edge part continuous to each other; and a flange portion continuously formed on the outer edge part of the top portion, the press forming method comprising:

a first forming step of forming a preformed part, the preformed part including a first part of the flange portion formed in the convex outer edge part and including a torsional shape portion having a torsional shape toward the concave outer edge part so as to be formed in the connecting edge part continuous from the first part of the flange portion, the first part of the flange portion being a portion of occurrence of shrink flange forming; and a second forming step of forming the preformed part formed in the first forming step into a target shape by forming the torsional shape portion into a second part of the flange portion and forming a third part of the flange portion in the concave outer edge part, the third part of the flange portion being a portion of occurrence of stretch flange forming.

2. The press forming method according to claim 1, wherein the first forming step and the second forming step are performed by using different dies.

3. The press forming method according to claim 1, wherein the first forming step and the second forming step are performed with a same die.

* * * * *